US008683859B2

(12) United States Patent
Godager

(10) Patent No.: US 8,683,859 B2
(45) **Date of Patent: *Apr. 1, 2014**

(54) PRESSURE MANAGEMENT SYSTEM FOR WELL CASING ANNULI

(75) Inventor: Oivind Godager, Sandefjord (NO)

(73) Assignee: Sensor Developments AS, Sandefjord (NO)

( * ) Notice: Subject to any disclaimer, the term of this patent is extended or adjusted under 35 U.S.C. 154(b) by 368 days.

This patent is subject to a terminal disclaimer.

(21) Appl. No.: 13/143,769

(22) PCT Filed: Jan. 7, 2010

(86) PCT No.: PCT/GB2010/000014

§ 371 (c)(1),
(2), (4) Date: Sep. 19, 2011

(87) PCT Pub. No.: WO2010/079327

PCT Pub. Date: Jul. 15, 2010

(65) Prior Publication Data

US 2012/0017673 A1 Jan. 26, 2012

(30) Foreign Application Priority Data

Jan. 9, 2009 (GB) ..... 0900348.4
Nov. 25, 2009 (GB) ..... 0920672.3

(51) Int. Cl.
*E21B 47/00* (2012.01)

(52) U.S. Cl.
USPC ..... 73/152.54

(58) Field of Classification Search
USPC ..... 73/152.51, 152.54
See application file for complete search history.

(56) References Cited

U.S. PATENT DOCUMENTS

| | | | | |
|---|---|---|---|---|
| 3,974,690 | A | 8/1976 | Brock, Jr. et al. | |
| 4,887,672 | A | 12/1989 | Hynes | |
| 6,513,596 | B2 | 2/2003 | Wester | |
| 7,140,434 | B2 * | 11/2006 | Chouzenoux et al. | 166/250.11 |
| 7,151,377 | B2 | 12/2006 | Chouzenoux et al. | |
| 7,602,668 | B2 * | 10/2009 | Liang et al. | 367/25 |
| 7,703,515 | B2 | 4/2010 | Chouzenoux et al. | |
| 2001/0035288 | A1 | 11/2001 | Brockman et al. | |
| 2003/0058125 | A1 | 3/2003 | Ciglenec et al. | |
| 2004/0094303 | A1 | 5/2004 | Brockman et al. | |
| 2004/0238166 | A1 * | 12/2004 | Salamitou et al. | 166/255.1 |
| 2006/0005965 | A1 | 1/2006 | Chouzenoux et al. | |
| 2007/0206440 | A1 * | 9/2007 | Fripp et al. | 367/81 |
| 2008/0106972 | A1 | 5/2008 | Liang et al. | |
| 2008/0277941 | A1 | 11/2008 | Bowles et al. | |
| 2012/0024050 | A1 * | 2/2012 | Godager | 73/152.05 |
| 2013/0110402 | A1 * | 5/2013 | Godager | 702/7 |

FOREIGN PATENT DOCUMENTS

| | | | |
|---|---|---|---|
| GB | 2353546 | A | 2/2001 |
| WO | 0165069 | A1 | 9/2001 |
| WO | 03056692 | A1 | 7/2003 |

* cited by examiner

*Primary Examiner* — John Fitzgerald
(74) *Attorney, Agent, or Firm* — Reinhart Boerner Van Deuren s.c.

(57) ABSTRACT

An apparatus and method to provide monitoring of pressure outside the wellbore casing of a well in which a Wireless Sensor Unit is placed externally of a section of non-magnetic casing. An internal Sensor Energizer Unit is placed inside the wellbore casing. The Wireless Sensor Unit includes one or more sensors to measure the pressure and/or temperature of the surroundings. The Wireless Sensor Unit and the Sensor Energizer Unit communicate using electromagnetic modulation techniques, and the Wireless Sensor Unit may be powered by means of power harvesting from the Sensor Energizer Unit.

35 Claims, 6 Drawing Sheets

PRESSURE MANAGEMENT SYSTEM FOR WELL CASING ANNULI

BACKGROUND OF THE INVENTION

Field of the Invention

This invention relates generally to a method and apparatus for the management of the pressure containing integrity of oil and gas production, injection and observation wells, and more particularly to a method and apparatus to accurately monitor in-situ the pressure and/or temperature in one or more well casing annuli without compromising the integrity of the well or well design in any way.

The management of the pressure containing integrity of oil and gas wells constitutes an ongoing concern of the petroleum industry. Those concerns are mainly due to the enormous monetary expenses involved in manufacturing and running any type of petroleum well as well as the risks associated with its environmental and safety issues. Herein, a petroleum type well is defined as any type of well that is drilled and equipped for the purpose of producing or storage of hydrocarbon fractures from or to subsurface formations. Further, petroleum type wells are categorized as any of combination, storage, observation, producing, or injection type wells.

Management of the pressure containing integrity of the well has become particularly more important and more complex as the close or surrounding annuli (i.e. Annulus-A) of the producing tubing or conduit is being used more and more actively to assist or help the production of a well. By this we mean the well design is such that you utilize Annulus-A (space) as the conduit for the supply of gas for the well artificial gas lift system. In these applications, the immediate annular space (Annulus-A) surrounding the production well no longer operates as and provides a barrier and/or safety design feature as of a traditional or prior art petroleum type well. Annulus-A is now being integrated as a part of and process element of the newer petroleum well production system. This in turn, forces the well designer to move the "active" annular barrier of the well one or more further steps outwards and away from the production tubing (i.e., to annulus-B or Annulus-C, etc).

Using the annular spaces of petroleum wells as an active part of the process system as described above requires a review of the safety and integrity of the entire well design. Previously, it was relatively straightforward to measure and monitor pressure and temperature of the immediate annular space of petroleum wells since the access to annulus-A could be obtained through the side of the wellhead housing or through the tubing hanger. Annulus-B, on the other hand, is more complicated, since it is physically terminated deeper down inside the wellhead housing and its access is terminated and securely sealed by the respective casing hanger. The reality in existing designs is that there is no easy or direct access to the outer annular spaces (i.e. Annulus-B, C, D . . . ) unless one selects to make some arrangement that will compromise the integrity of the pressure containment. This may be by means of puncturing the wall of the "barrier" (i.e. the wellhead housing, or the casing hanger) in some way to get hydraulic access in order to monitor the pressure of the void space by placement of some kind of known pressure or temperature sensing device.

There are numerous prior art patents related to the measurement of pressure in well casing annuli. One system is described by U.S. Pat. No. 6,513,596, to Wester. The system described is illustrative in nature and shows a well data monitoring system with sensors placed inside the outer annuli of a well casing program. The system is a non-intrusive approach to measure pressure and other parameters within a plurality of annuli spaces and preserves the pressure containing integrity of the well. The system shows sensors placed inside the annuli that communicate with an interrogation system located externally or internally of the wellhead housing. It confirms that the sensors will require power and communication to perform their operation and lists generally alternative sources to power and methods of communication without solving the actual challenges how to implement it in a real world application. This method is not believed to have been installed in any petroleum well or field.

U.S. Pat. No. 3,974,690, to Brock, Jr. et al., illustrates a method and apparatus to measure annulus pressure in a well. The method is mechanically complicated since it includes a moveable element that is operated in a differential pressure cell mode. The measuring side of the cell is exposed to the measurand (i.e. the pressure in the annulus) while the other side of the cell is exposed to the pressure charge of a pressure chamber. The movable element moves and stops when the pressure of the chamber equals that of the annuli. The method involves an electric control cable that is used to excite and read the position of the element. The control cable is hung by some means in the center of the tubing and from there run out of the well.

Firstly, primary elements that are movable are not favorable in petroleum well applications since they may become loose and result in damage to the well. Secondly, a cable coming out of the process tubing of a well is not contributing to maintaining required the pressure integrity or the safety of a well. Based on this fact it is difficult to see this system being used in practice to permanently monitor the pressure containment integrity of a petroleum well, and as such it must be considered a system of preliminary or provisory means only.

A third patent illustrates an approach by hydraulic communication or access means. U.S. Pat. No. 4,887,672, to Hynes, discloses a system that uses hydraulic couplers, internally drilled holes, and associated pressure ports to monitor the pressure containment integrity of the well. Orientation of the couplers prior to the wellhead makeup is critical and the couplers may easily be damaged. Further, each pressure port is subject to leak and increases the overall safety risk of the well.

Another related approach is described by U.S. Pat. No. 7,703,515, to Chouzenoux et al. The method described by this patent is magnetic saturation of the well casing or conduit to make a "window" for operating an AC magnetic field locally to excite a sensor located outside a casing. The principle described is not considered realistic due to a relatively high power consumption required to magnetically saturate the well casing. Further, the method would require uniform current flux within the material to be saturated which in turn would require optimum contact (evenly distributed contact resistance over the exposed area) performance of the electrodes applied. Due to the combination of exposed electrodes and high currents, such a system would rapidly degrade due to galvanic reactions (oxidation/corrosion) inside the pressure containment system of a well. Thus, the method is considered non-applicable for a prescribed permanent pressure management application.

SUMMARY OF THE INVENTION

The invention leads to better control and understanding of any pressure/temperature excursions inside a well casing annulus as the method and apparatus proposed enable distinguishing whether a change in containment pressure and temperature is caused by process or environmental fluctuations, or by a hazardous pressure leak from the well. Thus, the invention enhances the risk management and safety of the well as well as the surrounding environments, permitting any required action to be taken earlier to avoid hazardous events. This can last over the lifetime of the well.

The control and access of the petroleum well is provided through a wellhead. Thus, the service of the wellhead and its configuration provides a natural target structure for both prior art and the state-of-the-art technology in order to monitor and control the pressure of the plurality of well casing annuli surrounding the production tube or well. The present invention has applications to any petroleum type wells, for example located on land, on a platform, or at the seabed. However, for simplicity and to facilitate uniform understanding of the present invention, it is described herein particularly as it relates to a generic type petroleum well and wellhead.

An aspect of the present invention provides a method and apparatus for pressure management of a plurality of well casing annuli. In certain applications, the outer annuli between the well casings needs pressure monitoring to ensure that the well is being operated is a safe manner. Traditionally, only the annuli between the production tubing and the inner casing (production casing), has been monitored. Some applications of new production methods make use of the traditional annuli space (Annulus-A) as live elements of their process system. Consequently, new regulatory requirements arise and a need to move the traditional production casing barrier and well integrity outwards follows. The present invention discloses a non-intrusive method that preserves the pressure integrity of the well at the same time as it contributes to its safety.

A second aspect of the invention is that the pressure management system is able to predict the future pressure/temperature profile of the annuli space as a function of load changes. Typically load changes are caused by fluctuations in the process or the environment, which in turn induce pressure changes inside the pressure containment system of a well. Such changes are not hazardous in their origin and the ability to address them will contribute to the safety assessment of the well. As a result, the real-time acquisition of process and environment data in combination with the in-situ measurements constitute an important advance over the prior art in that the present invention can help management to anticipate and react to potential problems before they occur. In addition, the remote sensor package can be dressed with numerous and different evaluation sensors that may be important to evaluate the status and integrity of a plurality of well pressure containment systems.

In accordance with one aspect of the present invention, a Wireless Sensor Unit ("WSU") is provided. The WSU is a non-intrusive permanent management system provided for monitoring the pressure containment integrity of a well. A feature of the WSU is that it contains a Sensor Package ("SP") that permanently monitors pressure and temperature without compromising any of the pressure integrity barriers of the well casing annuli in any way. The SP is specific for the application and consists of a set of highly accurate quartz pressure and temperature sensor crystals and produces outputs of pressure and temperature as well as temperature gradients (i.e., change). In turn, the SP is connected to an Electromagnetic Transceiver ("ET") which includes circuitry for two-way communication and power harvesting. Both the SP and the ET are attached or integrated to the outer perimeter of a Non-Magnetic Casing Section ("NMCS") which is part of the well casing program (barrier).

Another aspect of the present invention is a Sensor Energizer Unit ("SEU") that is typically part of or attached to the well completion tubing. The SEU is adapted to host the Wireless Sensor Unit. The SEU consists of three main elements. The first and main element of the SEU is an Electromagnetic Armature ("EA"), the second element of the SEU is an Adjustable Mandrel ("AM"), and the third element of the SEU is a Cable Adaptor ("CA"). The EA provides as a combination of both a power source and a communications link for the WSU. The principal transmission of the EA is by low frequency induction or electromagnetic ("EM") means, which is picked up and converted to electrical energy by the WSU. To ensure optimum efficiency vis-à-vis the WSU, the EA is attached to the AM, which enhances the facility to "fine tune" or optimize the efficiency to host the WSU by vertical adjustment means. Also attached to the EA is a Cable Adaptor ("CA") that connects the control cable from outside of the well. The control cable is attached to the completion tubing by traditional cable clamps and exits the well through the wellhead, all according to prior art means. Typically, the control cable is a single-conductor Tubing Electric Cable ("TEC") type, providing power to the SEU as well as communication between the mentioned components and the monitoring facilities (i.e., outside the well).

For practical reasons the EA may be attached to an Adjustable Mandrel ("AM") that provides freedom of vertical adjustment/positioning of the EA with respect to the WSU. The freedom of vertical adjustment after being attached to the process tubing enables the operators involved to position it in an exact position adjacent to the WSU in the well without introducing "space-out" complexity, involving the completion or process tubing inside the well. Thus, the purpose of the AM is two-fold: first, to provide a holder, carrier, and/or protector for the EA; and second, to allow vertical adjustment so that the two main elements of the invention (i.e., the WSU and the SEU) are correctly arranged in relation to one another.

Depending on the degree of risk assessment required, the SEU may also include a Sensor Package ("SP") equal to that of the WSU to enhance more complex evaluation of the integrity of its pressure containment system.

According to one aspect of the present invention, there is provided apparatus to provide monitoring of pressure outside the wellbore casing of a well, the apparatus including a Wireless Sensor Unit ("WSU"), placed outside a section of a non-magnetic casing, the WSU including a sensor device to measure the pressure and/or the temperature of its surroundings, wherein the WSU may be installed or positioned at any elevation of the wellbore and wherein the WSU is powered by Power Harvesting wherein the frequency of the induction signal is in the range of 10-1000 Hz for deep penetration through the non-magnetic casing; an internal Sensor Energizer Unit ("SEU") placed inside the wellbore casing, the SEU being used for power and communication with the WSU, and wherein the SEU is attached to the well tubing or completion program by tubing having a thread that allows adjustment of its elevation, and wherein the SEU converts the DC power supplied on a cable from the surface to an alternating electromagnetic field that provides a source of power for the WSU outside the casing; wherein the SEU and the WSU use an electromagnetic modulation technique to provide communication of data between the two components.

The SEU may be arranged to be at the same elevation as that of the outer WSU. Further, the sensor may be mounted near the wellhead or tree structure of the wellbore. There may be two or more sensors in the WSU, and all sensors of the WSU may be placed on the outside of the wellbore casing without compromising the pressure integrity of the well.

The pressure sensors preferably measure one or more parameters of the annuli to which they is exposed. The sensors may be branched-off from the WSU and connected to a common electrical wire harness attached to the outside of the casing. The wiring harness may be either a single-conductor or multi-conductor type downhole Tubing Electric Cable ("TEC").

The apparatus may further include one or more power harvesting coils spaced out over a given section of the non-magnetic casing, and the WSU may include or be connected to a secondary energy source. This source may be either a battery or a downhole generator.

The SEU may optionally further include one or more sensors to measure parameters inside the wellbore casing or tubing to which it is attached. The sensors may be an integral part of the SEU, or they may be branched-off from the SEU and connected to a common electrical wiring harness, or they may be connected by a combination of integral sensors and sensors branched-off. The wire harness may be a single-conductor or multi-conductor type downhole Tubing Electric Cable ("TEC").

The sensors optionally measure one or more of the following properties: pressure, temperature, flow quantity, flow velocity, flow direction, turbidity, composition, oil level, oil-water interface level, density, salinity, radioactivity, displacements, vibrations, pH, resistivity, sand content, thermal conductivity, or any combination of thereof. They may also measure one or more of the following structural properties of the wellbore casing or tubing: shock, vibrations, inclinations, magnetic properties, electrical properties, tool-face or other type of tool orientation, as well as stress and strain properties, or any combination thereof. They may further measure one or more annuli or open hole properties on the outside of the wellbore, which properties may be selected from: pressure, temperature, resistivity, density, pH, electromagnetic and/or electrical fields, radioactivity, salinity, sound, sound velocity, and thermal conductivity, as well as other chemical and physical properties, or any combination thereof.

The apparatus may further include means to induce a response from the surroundings, which means may be selected from: a magnetic field source, an electric field source, sound waves, pressure, temperature, shear-force waves, some other final element or actuator part of downhole process control, or a final element or actuator used towards formation to assist any of above listed measurements, or any combination thereof.

The apparatus may further include one or more of: noise cancelling of parameter offsets due to offset created by the well process or environment; or prediction and correction of measurements due to gradients induced by the environment or well process system, in order to provide correct as well as real-time monitoring of the pressure integrity and status of the well.

The invention also extends to a method of monitoring pressure outside a wellbore casing of a well, the method including: installing a Wireless Sensor Unit ("WSU") including a sensor device at a location on the outside section of a non-magnetic casing of a wellbore; installing an internal Sensor Energizer Unit ("SEU") inside the wellbore casing at an elevation which is the same as the WSU outside the wellbore, wherein the SEU is used for power and communication with the WSU; powering the WSU by Power Harvesting wherein the frequency of the induction signal is in the range of 10-1000 Hz for deep penetration through the nonmagnetic casing; converting the DC power supplied to the SEU on a cable from the surface to an alternating electromagnetic field that provides a source of power for the WSU outside the casing; or using an electromagnetic modulation technique to provide communication of data between the SEU and the WSU.

Optional and preferred features of the apparatus as discussed above apply equally to the method of the present invention and will be discussed further in the specific description below.

DESCRIPTION OF THE DRAWINGS

The above-discussed and other features and advantages of the present invention will be appreciated and understood by those skilled in the art from the detailed description and drawings. Referring now to drawings, wherein like elements are numbered alike in the several figures.

DETAILED DESCRIPTION OF THE PREFERRED EMBODIMENT

Figure 1:
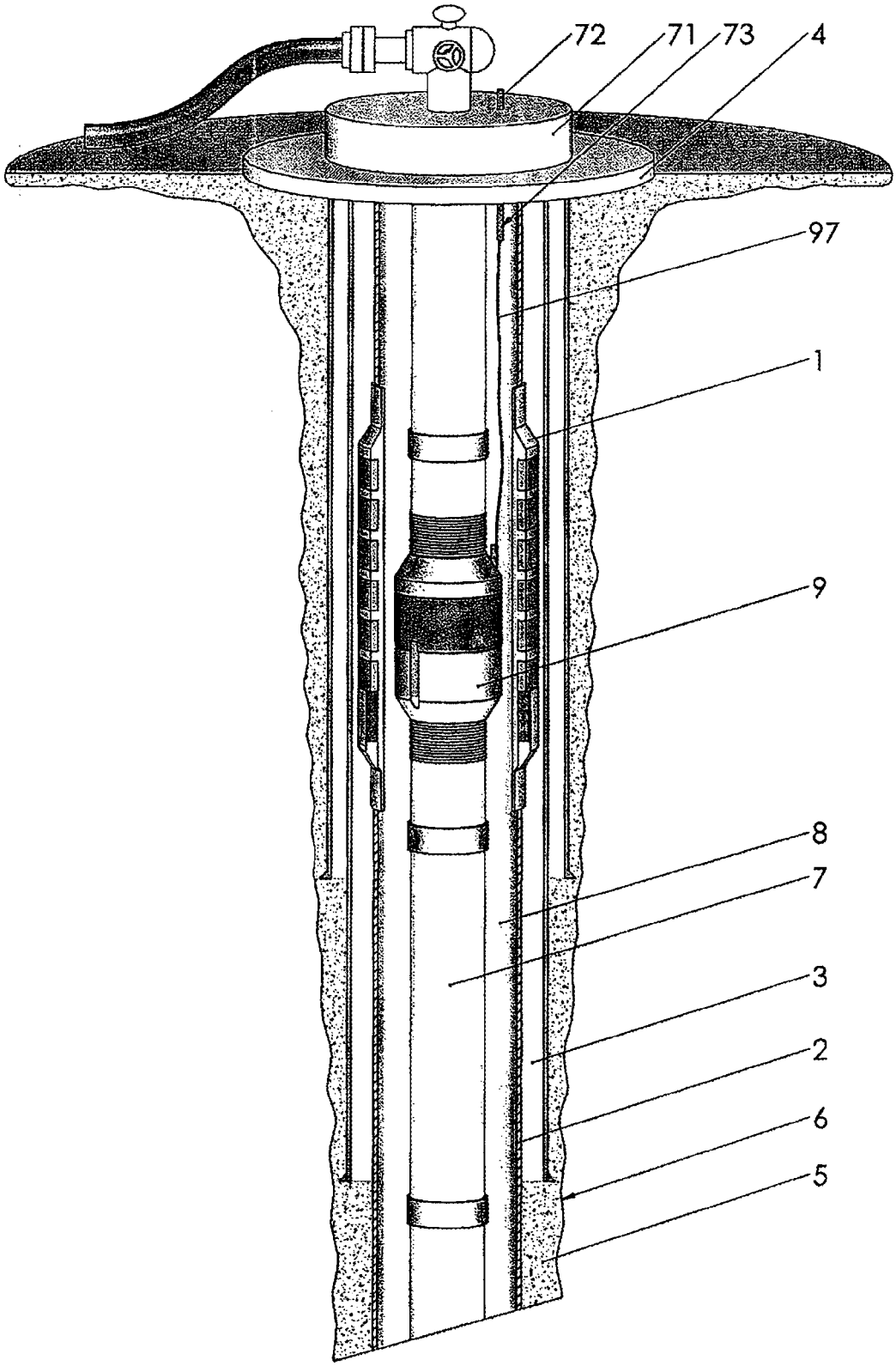
FIG. 1 is a diagrammatic view depicting the pressure management system for well casing annuli of the present invention for use in management and risk assessment of a plurality of petroleum well applications.
Figure 2:
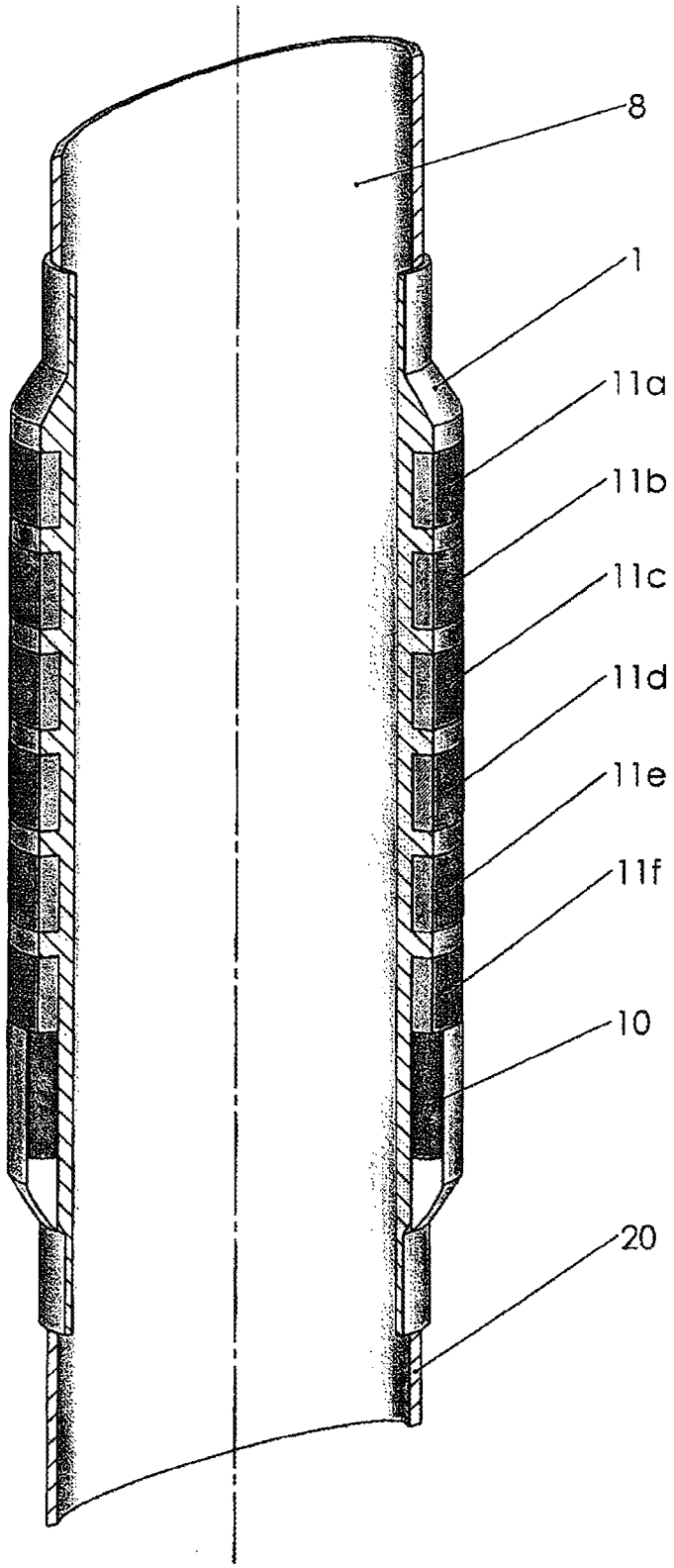
FIG. 2 shows an enlarged diagrammatic view of one aspect of FIG. 1 depicting the Wireless Sensor Unit ("WSU")

This invention relates to a system for monitoring the pressure integrity of well casing annuli. The annulus to monitor is typically the barrier that is closest to the well production system in order to avoid leaks and enhance safe operation. In particular as shown in FIG. 1, a Wireless Sensor Unit ("WSU") 1 in the present invention is made part of the casing program of the main production barrier 2 of the well. Referring to FIG. 2, a casing section 20 of the WSU 1 is made of a non-magnetic material and hosts a Sensor Package 10 and a plurality of Electromagnetic Transceivers (11*a-f*). For the purpose of this invention, the Sensor Package 10 is configured to measure and monitor the annular space 3 outside the main production barrier 2 of the well producing system (shown in FIG. 1).

Referring again to FIG. 1, this annular space 3 is also often referred to as Annulus-B, and the WSU 1 is typically positioned close to and underneath the wellhead structure or housing 4. The wellhead structure 4 is shown here in context, with the reference numeral 5 depicting the earth through which the well has been bored, and where the reference numeral 6 depicts the wellbore. The WSU 1 is wirelessly powered by a Sensor Energizer Unit ("SEU") 9 using electromagnetic means, also referred to herein as "power harvesting" (referred to as reference numeral 100 in FIG. 4) by those who are skilled in the art of electrical engineering. The WSU 1 is provided with supervisory circuits that enable two-way communications with the SEU 9. In turn, the communication is by electromagnetic means.

FIG. 2 shows the main elements of one component of the present invention in greater detail, which together define the configuration of the Wireless Sensor Unit 1. The WSU 1 consists of a Sensor Package ("SP") 10, an Electromagnetic Transceiver ("ET") 11*a-f*, and a Non-Magnetic Casing Section ("NMCS") 20. A more detailed connection and function diagram of the WSU 1 is illustrated on the right hand side of the dotted line of FIG. 4.

Again referring to FIG. 1, a second component of the present invention is the Sensor Energizer Unit ("SEU") 9. The SEU 9 is shown in greater detail in FIG. 3 and is typically mounted to a mandrel 91 and attached to a section of the production tubing 94. For the present illustration, the production tubing 94 is provided with an external thread 93, although this could equally be an internal thread. The external thread 93 allows the elevation of the SEU 9 to be adjusted so that the elevation of the SEU 9 in the well corresponds exactly with the elevation of the WSU 1. This will ensure proper communications as well as providing optimum efficiency of the power harvesting (reference 100 in FIG. 4).

Power supply and communications for the SEU 9 are provided through the Tubular Electric Cable ("TEC") 97 which is attached to the process tubing 7 and a feedthrough identified by the reference numerals 72 and 73 (shown in FIG. 1), typically exiting at a tubing hanger 71 (also shown in FIG. 1). The SEU 9 may also host a Sensor Package 95 (shown in FIG. 3), which in principle may be the same as the Sensor Package 10 of the WSU 1, but which may be configured to read parameters of the inner annulus 8. Typically, the inner annulus 8 is often referred to as Annulus-A by those skilled in the art.

Figure 3:
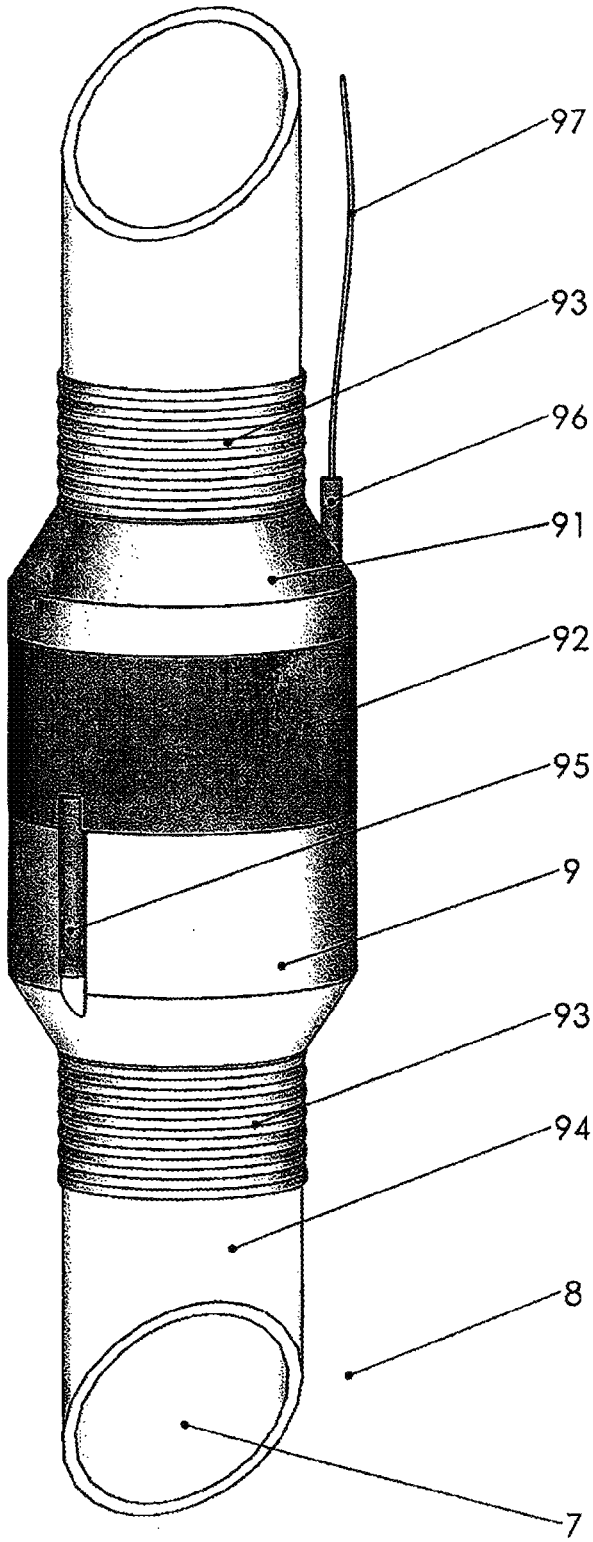
FIG. 3 shows an enlarged diagrammatic view of another aspect of FIG. 1 depicting the Sensor Energizer Unit ("SEU")
Figure 4:
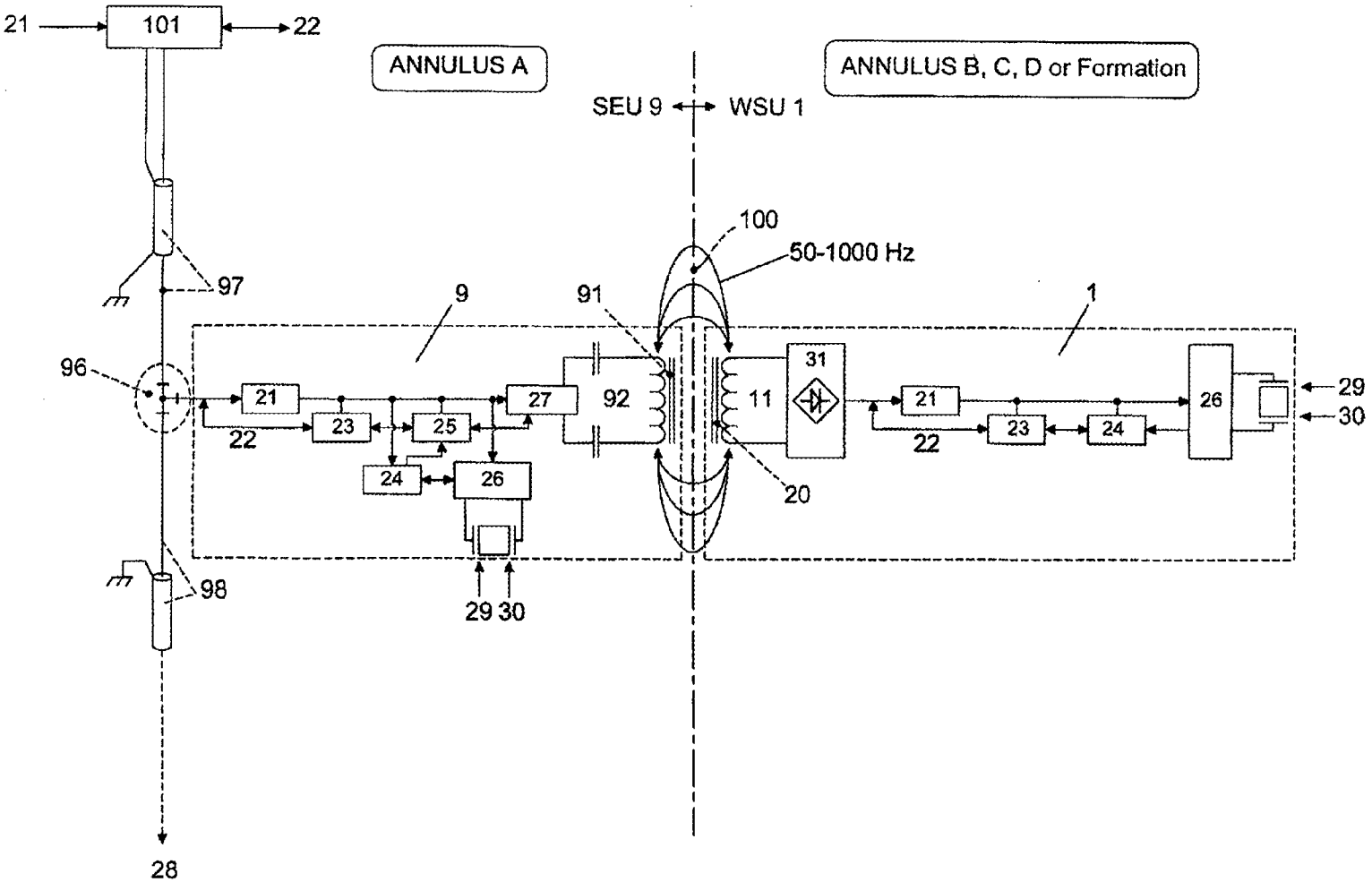
FIG. 4 shows a simplified electrical block diagram of the pressure management system in accordance with the present invention.

Referring to FIGS. 3 and 4, power to the SEU 9 is provided from the well site mounted Downhole Interface Unit ("DIU") 101 through a Tubing Electric able TEC conduit 97. The TEC 97 also hosts the communication in and out of the well between the DIU 101 and the SEU 9. Typically, the communication is by means of a signal superimposed onto the power since the TEC 97 is a single-conductor cable. The TEC 97 is terminated at the SEU 9 in a Cable Adaptor 96. Power is routed internally through the mandrel 91 and is connected to an Electromagnetic Armature ("EA") 92. A detailed description of the internal electronic functions and routing is provided in FIG. 4, referring to the components on the left hand side of the dotted line.

Also, if required, a Sensor Package ("SP") 95 may be adapted to provide more data for the evaluation of the pressure integrity of the annuli of interest. The SP 95 may be the same as the SP 10 of the WSU, but it may alternatively be any kind of sensor capable of providing data to enhance the safety and risk assessment of a particular well. For example, the SP 95 could measure one or more of the following properties: pressure, temperature, flow quantity, flow velocity, flow direction, turbidity, composition, oil level, oil-water interface level, density, salinity, radioactivity, displacements, vibrations, pH, resistivity, sand content, and thermal conductivity, as well as other chemical and physical properties.

As mentioned above, the EA 92 and the SP 95 may be attached to the mandrel 91. The mandrel 91 serves as both a holder for and protection of the mentioned elements and allows for adjustment to match the vertical position or elevation of WSU 1. The adjustment range of the present invention is typically in the range 0-50 cm, for example 10-40 cm or 25-35 cm, but may be more or less depending upon the requirement to provide freedom of proper space-out for the installation. Both the mandrel 91 and the process tubing 94 may be manufactured in a magnetic material.

Referring now to FIG. 4, a simplified electronic block diagram of the present invention is provided for those skilled in the art in order to visualize the inherent architecture as well as the operation of the system. As may be seen from the block diagram, one or more of the SEU 9 units may be attached to the control TEC 97. In FIG. 4, this is illustrated using an additional TEC 98 that leads to one or more additional SEU units shown generally by the reference numeral 28. In a multi-unit system (i.e., two or more SEU units 9 and 28), each SEU 9 or 28 is connected in a parallel configuration onto the cable 97. Due to relatively high power consumption, the nature of the system is also that only one of the SEU units 9 or 28 is active at a given time.

The active status of an SEU 9 or 28 is addressed during the initial start-up and through a command issued by the DIU 101 at the well site. At power-up, the DIU 101 actively addresses one of the SEU units 9 or 28 on the line and makes it the active node of the system. To change to another SEU 9 or 28, the DIU 101 simply powers-down the line to reset or resume. At the next power-up another SEU 9 or 28 may be addressed. Using this mode of operation, power is directed to one SEU 9 or 28 at a time, and the system is capable of hosting many SEU units 9 and 28 on the line without gross voltage drop on the TEC's 97 or 98 due to heavy loads.

Power harvesting 100 is achieved by correct vertical alignment of the SEU 9 in relation to the WSU 1. As mentioned above, this adjustment is provided by the adjustable mandrel 91. A second feature of this invention is the use of the non-magnetic casing section ("NMCS") 20 which makes the lower frequency (50-1000 Hz) electromagnetic field induced by the Electromagnetic Armature ("EA") 92 deep penetrating, and thus visible to the Electromagnetic Transceiver ("ET") 11 of the WSU 1. The efficiency of the power transfer is poor due to non-ideal conditions of the inductive coupling, however tests show that a ratio in the range of 20:1 is achievable and is sufficient to operate a low-power sensor package as described in the present invention.

Referring again to FIG. 4 in detail, the SEU 9 consists of a Power Supply 21 that provides a regulated DC current for the electronic functions of the unit. The SEU 9 is supervised by an internal Controller 25. Upon a wake-up call, the Controller 25 makes the address interpretation, and when addressed it turns on an internal Modulating Chopper Oscillator ("MCO") 27. The MCO 27 converts electrical energy into an alternating magnetic field through the Electromagnetic Armature 92. The induced field has a frequency that enables electromagnetic waves to propagate deeply into the surrounding structures, and thereafter be picked up by the Electromagnetic Transceiver ("ET") 11*a-f* of the WSU 1. The MCO 27 also assists in modulating data 22 in between the SEU 9 and the WSU 1.

The SEU 9 also has a Modem 23. The main purpose of the Modem 23 is to read and transmit data 22 from and to the power line or TEC 97. However, the data 22 going in and out of the SEU 9 is buffered and interpreted by the internal Controller 25. Crystal Sensors may be used for detecting pressure using a Crystal Sensor 29 and temperature using a Crystal Sensor 30 in the described device, and are driven by respective Oscillators 26 and each sensor crystal provides a frequency output as function of its measurand. The sensor frequency is measured by a Signal Processor 24 and is continuously feed to an input buffer of the Controller 25.

For the WSU 1, the internal electronic functions are equivalent to those for the SEU 9 with the exception of a Rectifying Bridge 31. The Rectifying Bridge 31 converts the alternating current induced by the local electromagnetic field into a DC voltage/current that internally powers the WSU 1. The prescribed electromagnetic principle used is referred to as Power Harvesting 100 by persons skilled in the art. For the purpose of this invention, the WSU 1 may be provided with highly accurate sensors for detecting pressure using a Crystal Sensor 29 and temperature using a Crystal Sensor 30. In principle, the WSU 1 may include a Sensor Package that may hold any kind of sensors to measure a plurality of measurement parameters to enhance the risk assessment of the pressure containment system of a well.

FIGS. 1 to 4 have generally shown a system including either a single sensor within the SEU 9 or two sensors, one within the SEU 9 and the other in the WSU 1.

Figure 5:
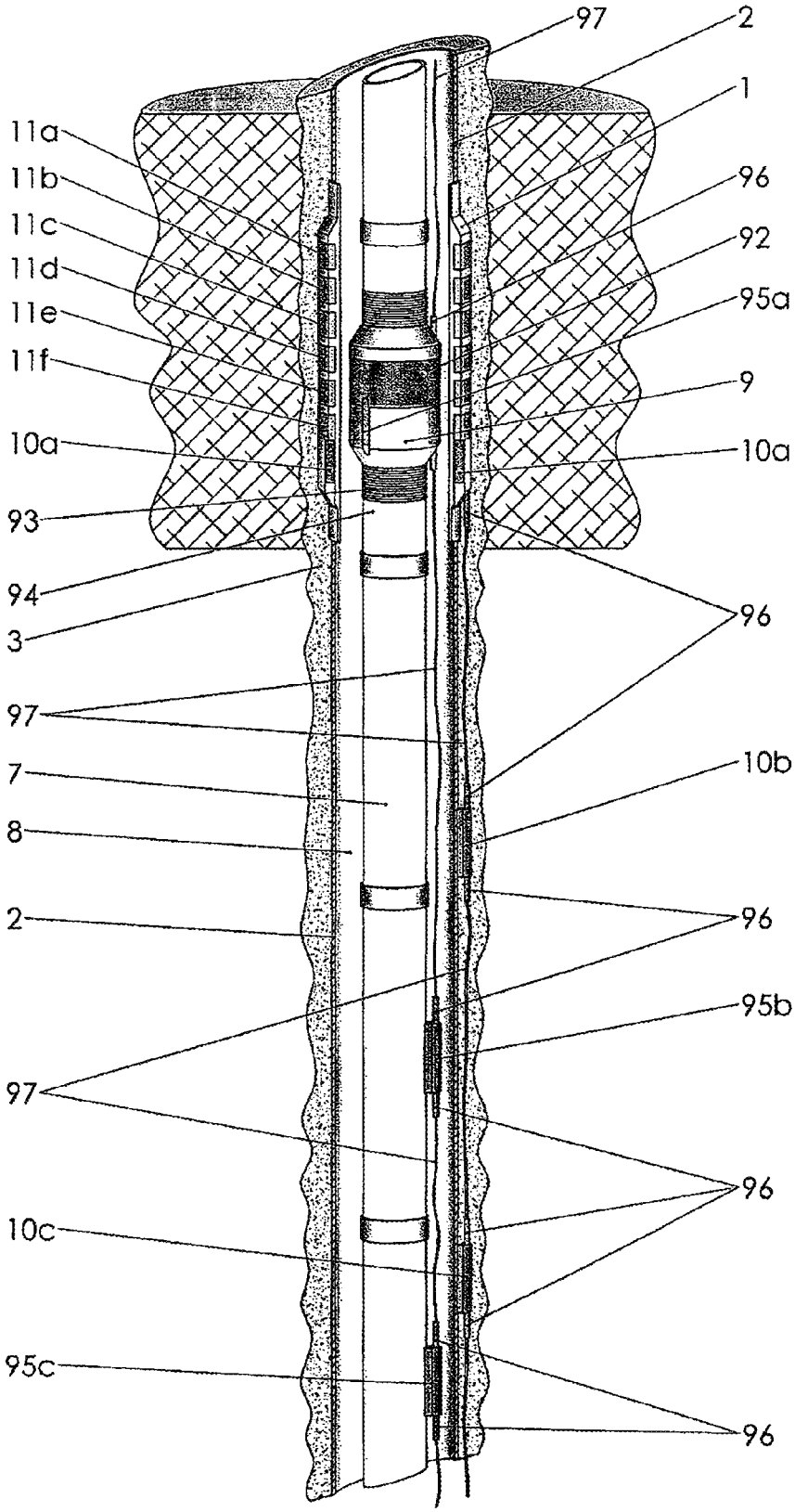
FIG. 5 is a diagrammatic view similar to FIG. 1, but showing the use of multiple sensors on either side of the wellbore casing.

FIG. 5 shows the system described by FIG. 1 expanded to include more sensors on either side of the wellbore casing 2. Similar reference numerals are used for similar features as those described with reference to FIGS. 1 to 4. On the inside, branched-off from the SEU 9 are three sensors 95*a*, 95*b* and 95*c*, for example, and on the outside, branched-off from the WSU 1 are three further sensors 10*a*, 10*b* and 10*c*, for example.

Figure 6:
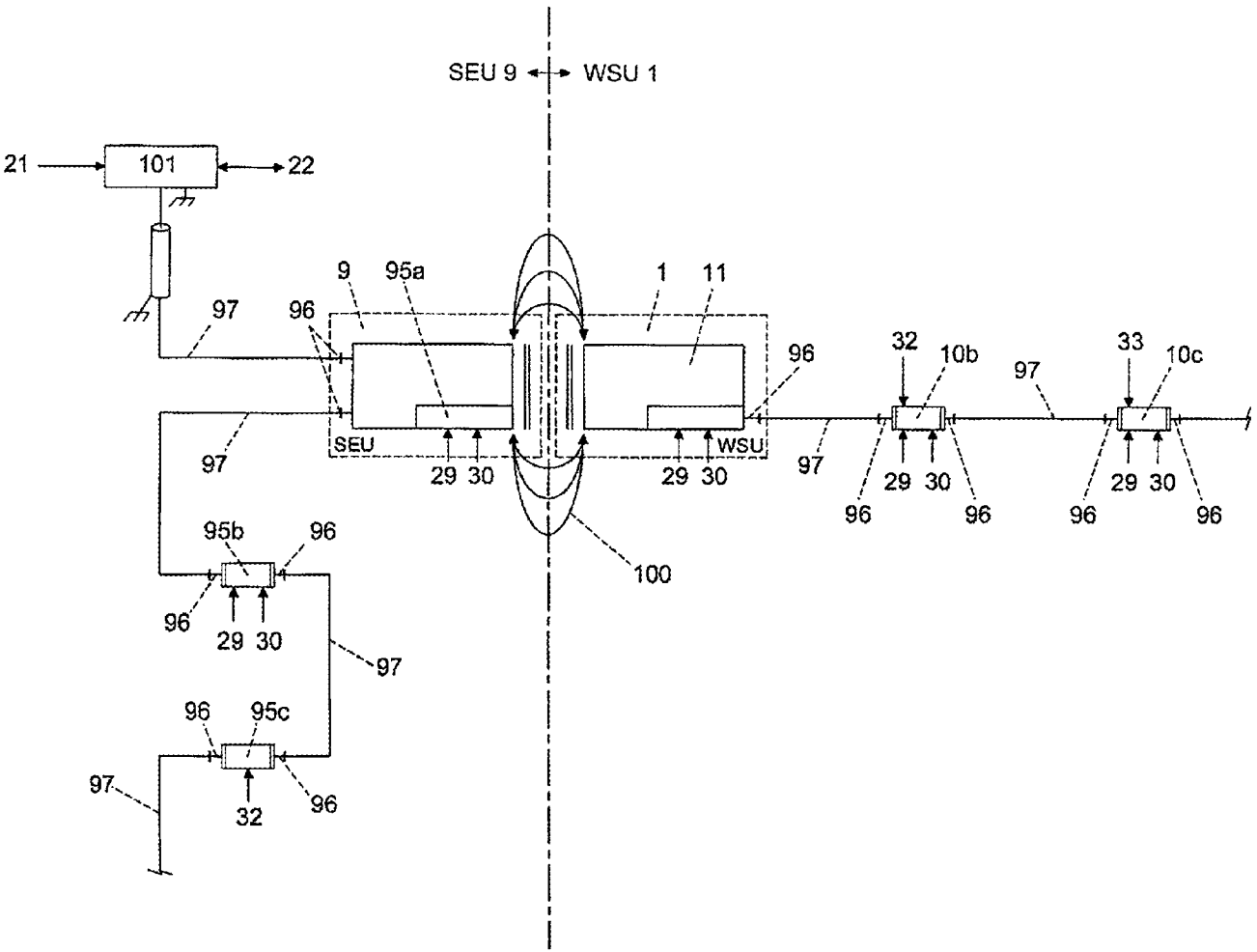
FIG. 6 is a block diagram showing a sensor network running from a single node.

FIG. 6 is the corresponding schematic block diagram showing the multiple sensors networked to operate from a single-node, and illustrates the cascading of sensors on both sides of the wellbore casing 2. Referring to FIG. 6, the sensors are depicted measuring open hole properties, for example, pressure using a sensor 29, temperature using a sensor 30, resistivity using a sensor 32, and the oil-water interface level using a sensor 33.

Although the foregoing description of the present invention has been shown and described with reference to particular embodiments and applications thereof, it has been presented for purposes of illustration and description and is not intended to be exhaustive or to limit the invention to the particular embodiments and applications disclosed. It will be apparent to those having ordinary skill in the art that a number of changes, modifications, variations, or alterations to the invention as described herein may be made, none of which depart from the spirit or scope of the present invention. The particular embodiments and applications were chosen and described to provide the best illustration of the principles of the invention and its practical application to thereby enable one of ordinary skill in the art to utilize the invention in various embodiments and with various modifications as are suited to the particular use contemplated. All such changes, modifications, variations, and alterations should therefore be seen as being within the scope of the present invention as determined by the appended claims when interpreted in accordance with the breadth to which they are fairly, legally, and equitably entitled.

What is claimed is:

1. Apparatus to provide monitoring of pressure outside the wellbore casing of a well, said apparatus comprising:

a Wireless Sensor Unit ("WSU") placed outside a section of a non-magnetic casing, said WSU including a sensor device to measure the pressure and/or the temperature of its surroundings, wherein the WSU may be installed or positioned at any elevation of a wellbore and wherein the WSU is powered by Power Harvesting where the frequency of an induction signal is in the range of 10-1000 Hz for deep penetration through the non-magnetic casing; and an internal Sensor Energizer Unit ("SEU") for placement inside the wellbore casing, said SEU being used to provide power to and communication with the WSU, wherein the SEU is attached to the well production tubing on a process tubing segment having a thread that allows adjustment of said SEU's elevation, and wherein the SEU converts DC power supplied by a cable from the surface to an alternating electromagnetic field that provides a source of power for the WSU outside the wellbore casing;

wherein the SEU and the WSU use an electromagnetic modulation technique to provide communication of data therebetween.

2. Apparatus as claimed in claim 1, wherein the SEU is arranged to be at the same elevation as that of the WSU.

3. Apparatus as claimed in claim 1, wherein the sensor device is mounted near a wellhead or tree structure of the wellbore.

4. Apparatus as claimed in claim 1, wherein the WSU further comprises one or more power harvesting coils spaced out over a given section of the non-magnetic casing.

5. Apparatus as claimed in claim 1, further comprising:

means to induce a response from surroundings, which means may be selected from the group consisting of a magnetic field source, an electric field source, sound waves, pressure, temperature, shear-force waves, another final element or actuator part of downhole process control, and a final element or actuator used towards formation to assist any of the previously listed measurements.

6. Apparatus as claimed in claim 1, further comprising:

apparatus for performing one or more of: noise cancelling of parameter offsets due to offset created by the well process or environment; and prediction and correction of measurements due to gradients induced by the environment or well process system, in order to provide correct as well as real-time monitoring of the pressure integrity and status of the well.

7. Apparatus as claimed in claim 1, wherein there are two or more sensors in the sensor device of the WSU.

8. Apparatus as claimed in claim 7, wherein all of the sensors of the WSU are arranged and configured for placement on the outside of the wellbore casing without compromising the pressure integrity of the well.

9. Apparatus as claimed in claim 7, wherein the sensors measure one or more parameters of an annulus to which they are exposed.

10. Apparatus as claimed in claim 7, wherein the sensors further measure one or more annulus or open hole properties on the outside of the wellbore casing, which properties may be selected from:

pressure, temperature, resistivity, density, ph, electro-magnetic and/or electrical fields, radioactivity, salinity, sound, sound velocity, thermal conductivity, as well as other chemical and physical properties.

11. Apparatus as claimed in claim 7, wherein the sensors are branched-off from the WSU and connected to a common electrical wire harness attached to the outside of the wellbore casing.

12. Apparatus as claimed in claim 4, wherein the wiring harness is either a single-conductor or a multi-conductor type downhole Tubular Electric Cable ("TEC").

13. Apparatus as claimed in claim 1, wherein the WSU further comprises or is connected to a secondary energy source.

14. Apparatus as claimed in claim 13, wherein the secondary energy source is selected from the group consisting of a battery and a downhole generator.

15. Apparatus as claimed in claim 1, wherein the SEU further comprises one or more sensors to measure parameters inside the wellbore casing or the well production tubing to which they are attached.

16. Apparatus as claimed in claim 15, wherein the sensors measure one or more of the following properties:

pressure, temperature, flow quantity, flow velocity, flow direction, turbidity, composition, oil level, oil-water interface level, density, salinity, radioactivity, displacements, vibrations, pH, resistivity, sand content, thermal conductivity, or any combination of the above.

17. Apparatus as claimed in claim 15, wherein the sensors measure one or more of the following structural properties of the wellbore casing or the tubing:

shock, vibrations, inclinations, magnetic properties, electrical properties, tool-face or other type of tool orientation, stress and strain properties, or any combination of the above.

18. Apparatus as claimed in claim 15, wherein the sensors are either or both an integral part of the SEU or branched-off from the SEU and connected to a common electrical wiring harness.

19. Apparatus as claimed in claim 18, wherein the wire harness is a single-conductor or a multi-conductor type downhole Tubular Electric Cable ("TEC").

20. A method of monitoring pressure outside a wellbore casing of a well, said method comprising:

installing a Wireless Sensor Unit ("WSU") including a sensor device at a location on the outside of a section of a non-magnetic casing of a wellbore;

installing an internal Sensor Energizer Unit ("SEU") inside the wellbore casing at an elevation which is the same as the location of the WSU outside the wellbore, wherein the SEU is used for power and communication with the WSU;

powering the WSU by Power Harvesting where the frequency of an induction signal is in the range of 10-1000 Hz for deep penetration through the non-magnetic casing;

converting DC power supplied to the SEU by a cable from the surface to an alternating electromagnetic field that provides a source of power for the WSU outside the non-magnetic casing; and using an electromagnetic modulation technique to provide communication of data between the SEU and the WSU.

21. A method as claimed in claim 20, wherein the sensors of the WSU are part of a wellbore pressure containment system (fluidic system) facing an outer or outside wellbore casing system or are cemented in place facing an outer or outside wellbore casing.

22. A method as claimed in claim 20, wherein one or more power harvesting coils is spaced out over a given section of the non magnetic casing;

wherein the mentioned coiled-section (from above) or band of the nonmagnetic casing provides the required completion or space-out tolerance for system when landing the well tubing (tubing-hanger) in the wellhead or tree.

23. A method as claimed in claim 20, wherein the sensors measure one or more properties selected from:

pressure, temperature, flow quantity, flow velocity, flow direction, turbidity, composition, oil level, oil-water interface level, density, salinity, radioactivity, displacements, vibrations, pH, resistivity, sand content, thermal conductivity, as well as other chemical and physical properties.

24. A method as claimed in claim 20, wherein the sensors measure one or more of the structural components of the wellbore casing or tubing as follows: Shock, vibrations, inclinations, magnetic properties, electrical properties, tool-face or other type of tool orientation, as well as stress and strain properties.

25. A method as claimed in claim 20, wherein the sensor further measures one or more annuli or open hole properties on the outside of the wellbore casing, selected from: pressure, temperature, resistivity, density, pH, electro-magnetic and/or electrical fields, radioactivity, salinity, sound, sound velocity, thermal conductivity, as well as other chemical and physical properties.

26. A method as claimed in claim 20, wherein a response is induced in the surroundings by one or more of the following means: magnetic fields, electric fields, sound waves, pressure, temperature, shear-force waves, other final element or actuator part of downhole process control, final element or actuator used towards formation to assist any of above listed measurements.

27. A method as claimed in claim 20, further including one or more of:

noise cancelling of parameter offsets due to offset created by the well process or environment; and prediction and correction of measurements due to gradients induced by the environment or well process system, in order to provide correct as well as real-time monitor of the pressure integrity and status of the well.

28. A method as claimed in claim 20, wherein all sensors of the WSU are permanently fixed on the outside of the wellbore casing without compromising the pressure integrity of the well or barrier.

29. A method as claimed in claim 28, wherein one or more sensors measures one or more parameters of the annuli to which it is exposed.

30. A method as claimed in claim 20, wherein the sensors are not part of the WSU but are branched-off and connected to a common electrical wire harness attached to the outside of the casing.

31. A method as claimed in claim 30, wherein the wiring harness is a single-conductor or multi-conductor type downhole Tubular Electric Cable ("TEC").

32. A method as claimed in claim 20, wherein the WSU further includes or is connected to a secondary energy source.

33. A method as claimed in claim 32, wherein the secondary energy source is selected from a battery or a downhole generator to provide additional power as required to assist the power harvesting.

34. A method as claimed in claim 20, wherein the SEU has at least one sensor to measure parameter inside the wellbore casing or tubing to which it is attached.

35. A method as claimed in claim 34, wherein the sensors are an integral part of the SEU or are branched-off from the SEU and connected to a common electrical wiring harness, or is a combination of integral sensor and sensors branched-off.

* * * * *